United States Patent [19]

Morell et al.

[11] Patent Number: 4,670,913

[45] Date of Patent: Jun. 9, 1987

[54] COVERALL WITH ELASTOMERIC PANELS

[75] Inventors: Lori A. Morell, Alpharetta; Joyce A. Wessel, Acworth, both of Ga.

[73] Assignee: Kimberly-Clark Corporation, Neenah, Wis.

[21] Appl. No.: 919,911

[22] Filed: Oct. 16, 1986

[51] Int. Cl.[4] ..... A41D 1/06; A41B 9/00

[52] U.S. Cl. ..... 2/227; 2/78 C

[58] Field of Search ..... 2/227, 69, 401, 238, 2/78 C, 79, 80

[56] References Cited

U.S. PATENT DOCUMENTS

| | | | |
|---|---|---|---|
| 1,277,074 | 8/1918 | Hitzeman | 2/78 C |
| 2,664,570 | 1/1954 | Artzt | 2/78 C |
| 4,488,317 | 12/1984 | Polsky | 2/227 |

OTHER PUBLICATIONS

Sales Brochure "Comfort and Protection, Now You Can Have Both" Kimberly-Clark.

*Primary Examiner*—Doris L. Troutman

*Attorney, Agent, or Firm*—William D. Herrick

[57] ABSTRACT

Nonwoven, limited wear coveralls consist of a matching left and right side panel joined together along a line extending from collar to crotch in front and back. In one embodiment, a portion of the line in back consists of a two to four-inch elastomeric strip. In a second embodiment, an elastomeric shoulder panel is provided in back along with an elastomeric strip from waist to crotch in back. In a third embodiment, elastomeric gussets are provided in back, and an elastomeric insert running from adjacent the waistline front and back and along the inseams of the legs.

11 Claims, 4 Drawing Figures

COVERALL WITH ELASTOMERIC PANELS

BACKGROUND OF THE INVENTION

This invention relates generally to limited-wear disposable coveralls of nonwoven material, and more particularly concerns such coveralls which have elastomeric nonwoven panels incorporated therein at particular stress points to enhance the fit, durability, and comfort of such coveralls.

In a variety of service industries, it is frequently required that workers be provided with coveralls in order to protect the workers and their clothing from contaminants which are to be found in the work place. Traditionally, such coveralls were constructed of heavy cloth material and were provided in numerous sizes to assure good fit and comfort. Such cloth coveralls, however, provide poor protection against harmful particles and liquid, they shed lint, and they require laundering.

In order to overcome the disadvantages of standard cloth coveralls, disposable coveralls have been introduced in various industries. Disposable coveralls are generally manufactured of nonwoven materials in order to assure that they are cost-effectively disposable. Particularly, coveralls sold under the mark Kleenguard® by Kimberly-Clark Corporation of Roswell, Georgia are manufactured of a three-layer fabric which has two outer layers of spun-bonded polypropylene filaments and an inner layer of melt-blown microfine polypropylene fibers. The outer layer of spun-bonded polypropylene provides a tough, durable, and abrasion-resistant surface. In addition, the inner layer acts as a filter barrier which is water-repellent allows air to pass and moisture to evaporate but which is able to filter out many harmful particles. The Kleenguard® coveralls are sold in sizes small, medium, large, extra large, and extra extra large.

While the Kleenguard® coveralls have enjoyed success in the market, we have found that such nonwoven coveralls provided even in five sizes may not comfortably fit all workers which are required to wear them. Particularly, we have found that such coveralls, if slightly small for an individual worker, may split at the seams when the worker bends, stoops, or lifts. Moreover, a garment that could be provided in fewer sizes while comfortably and effectively fitting a greater number of wearers is desired.

SUMMARY OF THE INVENTION

It is therefore an object of the present invention to provide a nonwoven, limited-wear, disposable coverall which incorporates elastomeric panels in its design at particular stress points in order to relieve the stresses on seams and to provide a more comfortable fit.

In order to attain the foregoing object, one embodiment of the coveralls of the present invention includes an elastomeric strip which extends from the collar seam to the crotch seam along the back of the coverall in place of the regular, fixed back seam.

In a second embodiment of the present invention, an elastomeric shoulder panel extends from the shoulder seams across the back of the coverall and joins the side panels together at the top instead of the conventional, fixed back seam adjacent the collar of the coverall. In addition, a strip of elastomeric material may be provided in the back of the coverall between the waist and the crotch of the coverall instead of that portion of the fixed back seam.

A third embodiment of the present invention includes elastomeric gussets or panels on either side of the fixed back seam. The elastomeric gussets extend from the collar to the waist and generally parallel to the fixed back seam. In addition, that same coverall may include a lower elastomeric panel which connects the side panels together between the waist and the crotch instead of the back seam and between the crotch and the front closure instead of a portion of the front seam. The lower panel may also extend down along the inseams of the leg from the crotch.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
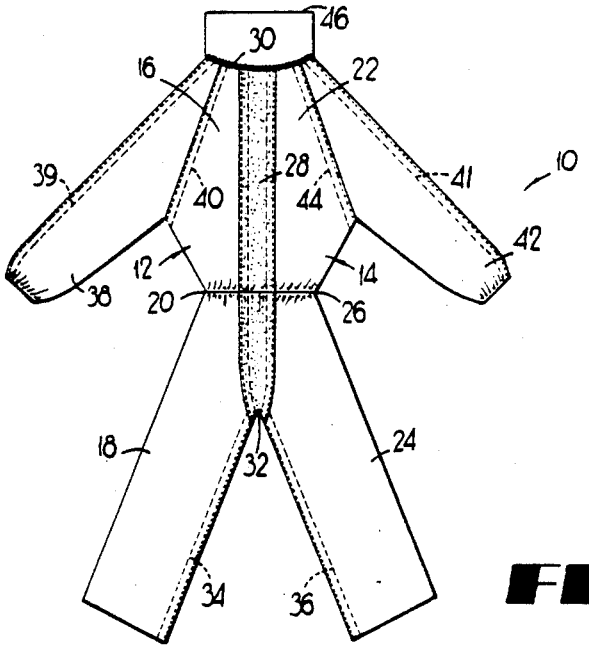
FIG. 1 is a back elevation view of a coverall illustrating one embodiment of the present invention.

Turning to FIG. 1, there is shown a coverall 10 embodying the present invention. The coverall consists of a left side panel 12 and a matching mirror image right side panel 14. The left side panel 12 has a body portion 16 and a leg portion 18 which are separated from each other by an elasticized waistline 20. Likewise, the right side panel 14 has a body portion 22 and a leg portion 24 separated from each other by an elasticized waistline 26.

The two side panels 12 and 14 are joined together in the back by a two to four-inch wide strip 28 of elastomeric material which extends along a line from collar seam 30 to crotch 32 of the coverall 10. The elastomeric strip 28 is provided instead of a conventional fixed back seam. The side panels 12 and 14 are joined together in the front by means of a conventional fixed front seam (not shown) extending from the crotch 32 toward waistlines 20 and 26 and terminating short of the waist. A zipper closure (not shown) extends from the termination of the fixed front seam to adjacent the collar seam in the front of the coverall.

The legs are formed by joining the leg portion 18 to itself along fixed inseam 34 to form the left leg and by joining the leg portion 24 to itself along fixed inseam 36 to form the right leg. A left sleeve 38 with sleeve seam 39 is connected to the body portion 16 of the left side panel 12 along a shoulder seam 40. Likewise, a right sleeve 42 with sleeve seam 41 is connected to the body portion 22 of the right side panel 14 along a shoulder seam 44. A collar 46 may be added to the coverall by stitching the collar 46 to the sleeve 38, body portion 16, elastic strip 28, body portion 22, and sleeve 42, along collar seam 30.

The coverall 10 shown in FIG. 1 thus has a two to four-inch wide elastomeric strip 28 running from collar seam 30 to the crotch 32 on the back of the coverall instead of a conventional fixed back seam. The elastomeric strip 28 serves to join the two side panels 12 and 14 together. Consequently, as the wearer bends, stoops, or reaches forward, the elastomeric strip 28 stretches to accommodate movement, thereby relieving pressure on the shoulder seams 40 and 44 and inseams 34 and 36 of the coverall 10.

The material used in making the coveralls, except for the elastomeric material, is preferably a three-layered material of spun-bonded polypropylene on the inside and outside of the coverall and a layer of melt-blown polypropylene sandwiched between the two layers of spun-bonded material. The material is used in coveralls that are manufactured and sold by Kimberly-Clark Corporation of Roswell, Georgia under the trademark Kleenguard. Such material is well-known in the coverall art.

The elastomeric material of which strip 28 is made is a 30/60/30 laminate polyurethane/ethylene-vinyl acetate/polyurethane. Particularly, the polyurethane is an aromatic polyurethane with good bonding characteristics and ultraviolet stability. The polyurethane layers of the laminate are formed by conventional melt-blowing techniques, and the preferred polyurethane is Q-Thane PE 90-100, manufactured by K. J. Quinn Company. The ethylenevinyl acetate layer of the laminate is also produced by conventional melt-blowing techniques, and the preferred ethylene-vinyl acetate is Escorene Ultra LD 764, manufactured by Exxon Corporation. The 30/60/30 designation describes the basis weight in grams per square meter of each of the layers of polyurethane, ethylene-vinyl acetate, and polyurethane. The resulting elastomeric material preferably has the following characteristics:

| | |
|---|---|
| Basis Weight: | 3.3 oz./yd.$^2$ |
| Grab Tensile Strength | |
| Machine Direction | 6.5 lbs. |
| Cross Direction | 4.6 pounds |
| Trap Tear Strength | |
| Machine Direction | 2.7 pounds |
| Cross Direction | 2.4 pounds |
| Frasier Porosity | 75 ft.$^3$/ft.$^2$/minute |
| Tabor Abrasion Test | 100+ cycles |
| Hydro-head | 20 cm |
| Peak Elongation | |
| Machine Direction | 400–500% |
| Cross Direction | 350–450% |
| Peak Energy | |
| Machine Direction | 5–9 ft.-lbs. |
| Cross Direction | 2–6 ft.-lbs. |
| Elastic Limit | |
| Machine Direction | 30–40% |
| Cross Direction | 25–35% |
| Set at 50% Elongation | |
| Machine Direction | 8–10% |
| Cross Direction | 8–10% |
| After 5 cycles | |
| Machine Direction | 10–12% |
| Cross Direction | 10–14% |
| Set at 150% Elongation | |
| Machine Direction | 15–20% |
| Cross Direction | 18–23% |
| After 5 Cycles | |
| Machine Direction | 30–32% |
| Cross Direction | 30–33% |

The above parameters relate to specific characteristics of the material. For example, the grab and trap tear measure the strength of the material. Grab tensile strength simulates pulling action applied to the fabric during use and measures pounds of force required to break the fabric. Higher values of course indicate greater strength. Grab tensile strength was tested using Federal Test Method (FTM) 191A. Trap tear strength was tested using ASTM D-1117-14. Frasier porosity measures fabric porosity as an amount of air that passes through a fabric in a given period of time. It is used to determine the breatheability of the fabric and the results are reported in cubic feet per minute with a higher value indicating better porosity and better comfort. Frasier porosity was tested in accordance with FTM 191A, Method 5450. The Taber test is a test which measures the abrasion resistance of the material and the test was conducted in accordance with FTM 191A, Method 5306. Hydrohead measures the repellancy of the fabric to an increasing volume of water. Values are reported in centimeters with higher values indicating better repellancy and thus better protection for the wearer. Hydrohead was tested in accordance with FTM 191A, Method 5514. The peak elongation is the increase in length of the material before rupture. The peak energy is the total energy under the load in pounds versus elongation in feet of the samples. The elastic limit is the percentage of elongation where there is 95% recovery of the relaxed sample length. The 50% elongation set point specifies the amount of length that the material does not recover after being elongated 50%. The five cycle 50% elongation set point gives the same results after the material has been stretched 50% and relaxed five times. The 150% set point is established in the same manner as the 50% set point.

Figure 2:
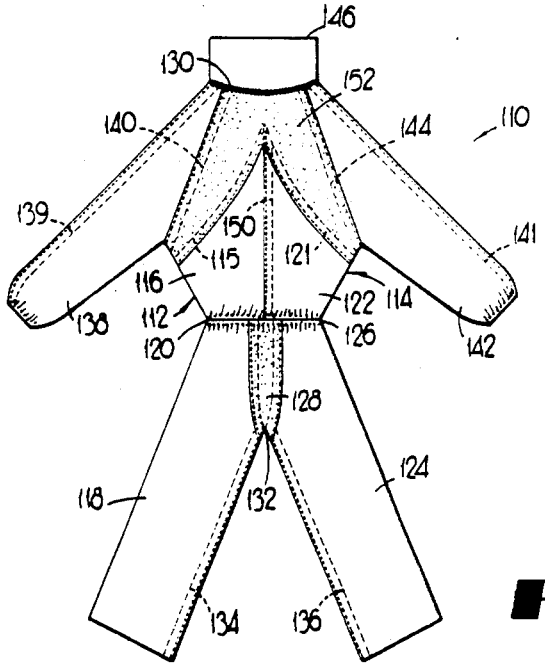
FIG. 2 is a back elevation view of a coverall illustrating a second embodiment of the present invention.

Turning to FIG. 2, there is shown a coverall 110 which is a second embodiment of the present invention. The coverall 110 consists of a left side panel 112 and a matching mirror image right side panel 114. The left side panel 112 has a body portion 116 and a leg portion 118 which are separated from each other by an elasticized waistline 120. Likewise, the right side panel 114 has a body portion 122 and a leg portion 124 separated from each other by an elasticized waistline 126.

The two side panels 112 and 114 are joined together in the back by a back seam 150 which extends along a portion of a line extending from collar seam 130 to crotch 132 of the coverall 110. An elastomeric shoulder panel 152 is connected to the left and right body portions 116 and 122 along diagonal seams 115 and 121. In addition, the two side panels 112 and 114 are joined together in back by a two to four-inch wide elastomeric strip 128 which extends from the waistlines 120 and 126 to the crotch 132. The side panels 112 and 114 are joined together in front by means of a conventional fixed front seam (not shown) extending from the crotch 132 and terminating short of the waist. A zipper closure (not shown) extends from the termination of the fixed front seam to adjacent the collar seam in the front of the coverall.

The legs are formed by joining the leg portion 118 to itself along fixed inseam 134 to form the left leg and by joining the leg portion 124 to itself along a fixed inseam 136 to form the right leg. A left sleeve 138 with a sleeve seam 139 is connected to the elastomeric shoulder panel 152 along a shoulder seam 140. Likewise, a right sleeve 142 with sleeve seam 141 is connected to the elastomeric shoulder panel 152 along a shoulder seam 144. A collar 146 may be added to the coverall by stitching the collar 146 to the sleeve 138, elastomeric shoulder panel 152, and the sleeve 142 along collar seam 130.

The coverall 110 shown in FIG. 2 thus has the elastomeric shoulder panel 152 extending between the shoulder seams 140 and 144 and diagonal seams 115 and 121. Consequently, as the wearer bends, stoops, or reaches forward, the elastomeric shoulder panel 152 stretches to accommodate movement, thereby relieving stress on the shoulder seams 140 and 144 and the diagonal seams 115 and 121. Also, the elastomeric strip 128 along a line extending from the waist to the crotch in the back, serves to relieve stress when the wearer bends forward.

Figure 3:
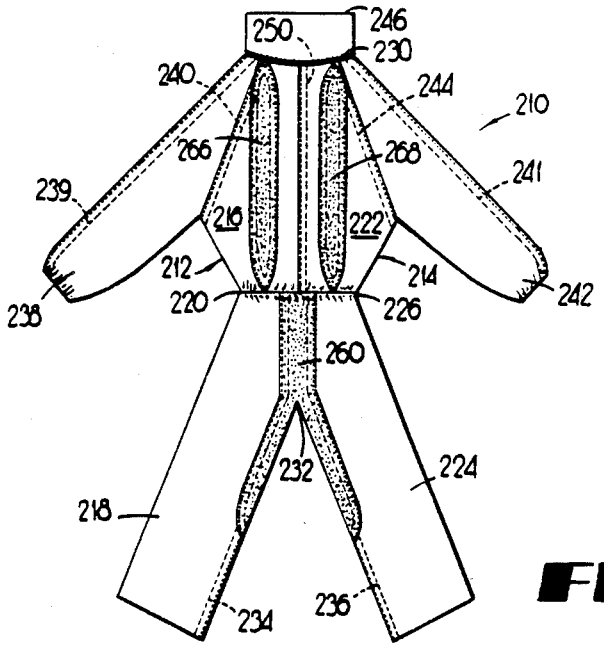
FIG. 3 is a back elevation view of a coverall illustrating a third embodiment of the present invention.
Figure 4:
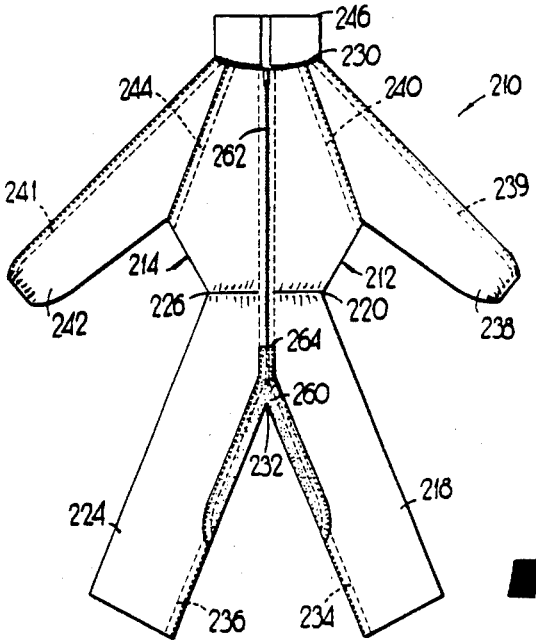
FIG. 4 is a front elevation view of the coverall of FIG. 3.

Turning to FIGS. 3 and 4, there is shown a coverall 210 which is a third embodiment of the present invention. The coverall consists of a left side panel 212 and a matching mirror image right side panel 214. The left side panel 212 has a body portion 216 and a leg portion 218 which are separated from each other by an elasticized waistline 220. Likewise, the right side panel 214 has a body portion 222 and a leg portion 224 separated from each other by an elasticized waistline 226.

The two side panels 212 and 214 are joined together in the back by a conventional fixed back seam 250 extending from a collar seam 230 to the waistlines 220 and 226. In addition, the left side panel and the right side panel 212 and 214 are joined together in back from the waistlines 220 and 226 to the crotch 232 by an elastomeric insert 260. The elastomeric insert 260 also extends from the crotch 232 toward the bottom of the legs along portions of inseams 234 and 236.

The side panels 212 and 214 are also joined together in front by means of the elastomeric insert 260 which extends from the crotch 232 upward toward the waistlines 220 and 226 and ends at terminating point 264. The side panels 212 and 214 are also joined in front by means of a zipper closure 262 which extends from adjacent the collar seam 230 to the terminating point 264 of the elastomeric insert 260.

Each body panel 216 and 222 has an elongated, oval-shaped gusset 266 and 268 respectively. The gussets 266 and 268 extend from adjacent the collar seam 230 to adjacent the waistlines 220 and 226.

Consequently, as the wearer of the coverall 210 bends, stoops, or reaches forward, the gussets 266 and 268 relieve stress on the back seam 250 and the shoulder seams 240 and 244. In addition, the elastomeric insert 260 relieves pressure on the inseams 234 and 236.

We claim:

1. In a coverall having a left side panel and a right side panel, wherein the left side panel and the right side panel are adapted to be joined to each other in back along a line extending from collar to crotch, along leg inseams, and along a front seam including a closure, the improvement comprising an elastomeric strip for joining the left side panel and the right side panel together in back and extending along at least a portion of the line from collar to crotch.

2. The coverall of claim 1, wherein the elastomeric strip is between 2 and 4 inches wide and has an elastic limit of between 25% and 40%.

3. The coverall of claim 1, wherein the elastomeric strip is a laminate of polyurethane, ethylene-vinyl acetate, and polyurethane.

4. In a coverall having a left side panel with a left waistline, a right side panel with a right waistline, a left sleeve, and a right sleeve, wherein the left side panel and the right side panel are adapted to be joined to each other in back along a line extending from collar to crotch, along leg inseams, and along a front seam including a closure, and wherein the left sleeve and the right sleeve are adapted to be joined to the left side panel and right side panel along a left shoulder seam and a right shoulder seam respectively, the improvement comprising an elastomeric shoulder panel attached to and extending between the left shoulder seam and right shoulder seam in back and for joining the left side panel and the right side panel together adjacent the collar along a portion of the line.

5. The coverall of claim 4, wherein the coverall further includes an elastomeric strip for joining the left side panel and right side panel together in back along at least a portion of the line between the left and right waistlines and the crotch.

6. The coverall of claim 4 or 5, wherein the elastomeric strip and elastomeric shoulder panel have an elastic limit of between 25% and 40%.

7. The coverall of claim 4 or 5, wherein the elastomeric strip and elastomeric shoulder panel are laminates of polyurethane, ethylene-vinyl acetate, and polyurethane.

8. In a coverall having a left side panel with a left waistline, a body portion, and integral leg panel and a right side panel with a right waistline, a body portion, and integral leg panel, wherein the left side panel and the right side panel are adapted to be joined to each other in back along a back line extending from collar to crotch, along leg inseams, and in front along a front line including a closure, the improvement comprising elastomeric gussets in the back of the body portion of the left and right side panels on either side of the line and extending parallel to the line for a portion of each body portion.

9. The coverall of claim 8, wherein the coverall further includes an elastomeric insert for joining the left side panel and the right side panel in back along a portion of the back line between the waistlines and the crotch, for joining the left side panel and the right side panel in front along a portion of the front line extending from the crotch to adjacent the closure, and extending from the crotch along the leg panels for joining each leg panel along a portion of each leg inseam.

10. The coverall of claim 8 or 9, wherein the elastomeric strips and panels have an elastic limit of between 25% and 40%.

11. The coverall of claim 8 or 9, wherein the elastomeric gussets and panel are laminates of polyurethane, ethylene-vinyl acetate, and polyurethane.

* * * * *